US007650102B2

(12) United States Patent
Zehentbauer et al.

(10) Patent No.: US 7,650,102 B2
(45) Date of Patent: Jan. 19, 2010

(54) METHOD, DEVICE AND COMPUTER PROGRAM FOR PRODUCING A DEVELOPER MIXTURE IN AN ELECTROGRAPHIC DEVELOPER STATION

(75) Inventors: Martin Zehentbauer, Gauting (DE); Bernd Hausmann, Olching (DE); Thomas Schwarz-Kock, Marzling (DE)

(73) Assignee: Oce Printing Systems GmbH, Poing (DE)

( * ) Notice: Subject to any disclaimer, the term of this patent is extended or adjusted under 35 U.S.C. 154(b) by 267 days.

(21) Appl. No.: 11/719,982

(22) PCT Filed: Nov. 28, 2005

(86) PCT No.: PCT/EP2005/012697

§ 371 (c)(1),
(2), (4) Date: May 23, 2007

(87) PCT Pub. No.: WO2006/058686

PCT Pub. Date: Jun. 8, 2006

(65) Prior Publication Data

US 2008/0089719 A1 Apr. 17, 2008

(30) Foreign Application Priority Data

Nov. 30, 2004 (DE) ..... 10 2004 057 856

(51) Int. Cl.
*G03G 15/08* (2006.01)

(52) U.S. Cl. ..... 399/259; 399/257

(58) Field of Classification Search ..... 399/27, 399/29, 257, 258, 259
See application file for complete search history.

(56) References Cited

U.S. PATENT DOCUMENTS

| | | | | |
|---|---|---|---|---|
| 4,511,639 | A | 4/1985 | Knott et al. | |
| 4,614,165 | A * | 9/1986 | Folkins et al. | 399/257 |
| 4,629,309 | A * | 12/1986 | Tsukano et al. | 399/257 |
| 4,903,051 | A | 2/1990 | Egawa et al. | |
| 5,450,178 | A | 9/1995 | Kawashima et al. | |
| 5,592,270 | A | 1/1997 | Takai et al. | |
| 5,621,052 | A | 4/1997 | Szita et al. | |
| 5,930,563 | A | 7/1999 | Reichl et al. | |
| 6,125,243 | A * | 9/2000 | Shoji et al. | 399/29 |
| 6,141,523 | A | 10/2000 | Bergmann et al. | |
| 6,181,885 | B1 | 1/2001 | Best et al. | |
| 6,181,902 | B1 | 1/2001 | Kopp | |
| 6,246,856 | B1 | 6/2001 | Kopp et al. | |
| 7,177,557 | B2 * | 2/2007 | Kreckel | 399/27 |
| 2004/0120732 | A1 | 6/2004 | Tokoro et al. | |

FOREIGN PATENT DOCUMENTS

| | | |
|---|---|---|
| DE | 195 40 138 | 12/1996 |
| EP | 1 016 935 | 5/2002 |
| EP | 1 455 240 | 9/2004 |
| JP | 62-63965 | 3/1987 |
| WO | WO 98/27466 | 6/1998 |
| WO | WO 98/27472 | 6/1998 |
| WO | WO 98/39691 | 9/1998 |
| WO | WO 02/067060 | 8/2002 |

* cited by examiner

*Primary Examiner*—Sandra L Brase
(74) *Attorney, Agent, or Firm*—Schiff Hardin LLP

(57) ABSTRACT

In a method for generating a developer mixture in a developer station of an electrographic printing device, magnetizable carrier particles and toner are simultaneously filled into the developer station, and in case of an error or an aborting of the filling a continuation takes place at a later time of the method.

17 Claims, 10 Drawing Sheets

METHOD, DEVICE AND COMPUTER PROGRAM FOR PRODUCING A DEVELOPER MIXTURE IN AN ELECTROGRAPHIC DEVELOPER STATION

BACKGROUND

The preferred embodiment relates to a method and an apparatus for generating a developer mixture in a developer station for an electrographic printing or copying device. Such devices operate in accordance with the electrographic principle according to which image information is generated on an intermediate carrier pixel-by-pixel by, for example, electrical, magnetic and/or optical signals in the form of an electric charge or magnetic fields, and the intermediate carrier is inked with toner pixel-by-pixel. The inking is done in particular with a two-component developer mixture and can be achieved with the aid of a magnetic brush generated with magnets or according to the so-called "toner jump" principle. The developer mixture comprises charged and/or magnetized particles, so-called carrier particles, and toner. The toner image can then be transfer-printed onto a recording medium, in particular onto paper.

A printing device operating in accordance with the electrophotographic principle according to which the image information is generated on a photoconductive layer by means of light is known from DE-C1-19540138. From WO-A1-98/27472, a developer station operating according to the "toner jump" method is known.

From U.S. Pat. No. 4,511,639, a method for recovering a developer mixture in an electrophotographic printing system is known. Although the lifetime of the developer mixture can be increased by such methods, it is necessary from time to time to completely replace the mixture in order to guarantee a high quality of the printed images.

From EP-B1-1 016 935, a printing system is known in which aggregates such as a developer station have an electronic memory for storing operating values.

From WO-A2-02/067060, a method for the continuous replacement of carrier particles in a developer station is known.

From WO-A1-98/39691, an electrophotographic printing device is known which comprises several developer stations. WO-A1-98/27466 shows an equivalent device.

From U.S. Pat. No. 5,592,270, a method for filling an electrophotographic developer station with carrier particles and toner is known, wherein the toner inflow and the carrier particles inflow can each be separately controlled.

From EP-B1-1 016 935, a printing device is known, in which various aggregates are provided with an electronic memory element in which aggregate-specific values can be permanently stored.

The afore-mentioned publications are herewith incorporated by reference into the present application.

In large electrographic printing devices having high printing rates of some dozens of pages DIN A4 per minute up to more than 1000 pages DIN A4 per minute, relatively large amounts of developer mixtures have to be provided. In such devices, this provision is relatively time-consuming if the toner and the ferromagnetic carrier particles are only mixed when they are already in the developer station and, in addition have to be activated, i.e. have to be continuously mixed with one another over a certain minimum amount of time in order to build up a triboelectric potential in the developer mixture. This time-consumption is particularly disadvantageous insofar as during this time the printing machine is out of service.

SUMMARY

It is an object to improve developer mixture-related processes for electrographic devices.

In a method for generating a developer mixture in a developer station of an electrographic printing device, magnetizable carrier particles and toner are simultaneously filled into the developer station, and in case of an error or an aborting of the filling a continuation takes place at a later time of the method.

DESCRIPTION OF THE PREFERRED EMBODIMENT

Figure 1:
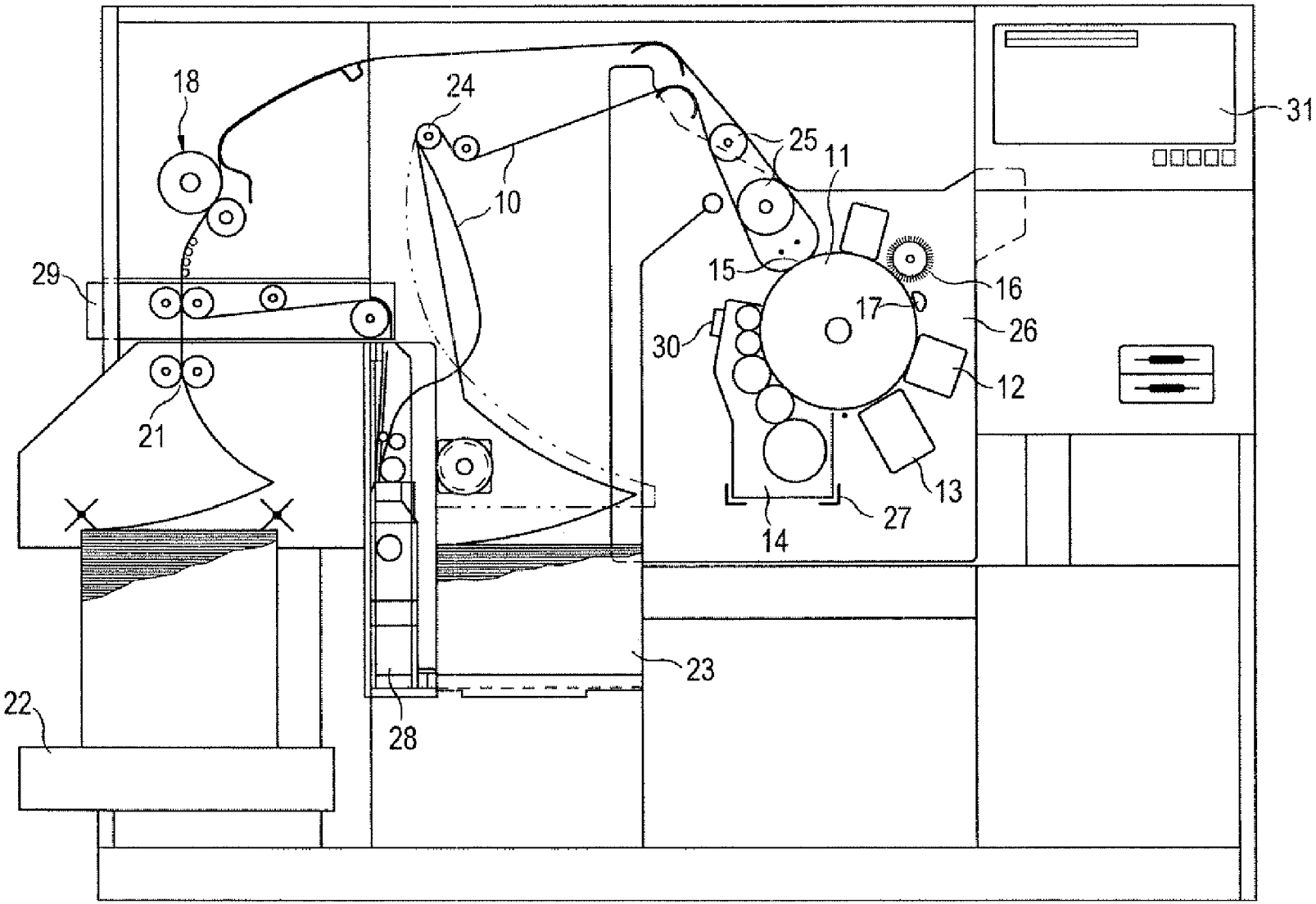
FIG. 1 shows an electrographic high-performance printing device.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

According to a first aspect of the preferred embodiment, magnetizable and in particular ferromagnetic carrier particles and toner are simultaneously filled into a developer station of an electrographic printing device for generating a developer mixture in the developer station. What is achieved thereby is a process parallelism of the two filling processes.

By running individual phases of the overall process "change of mixture" in parallel, a considerable time optimization is achieved. If a device comprises several developer stations, a further optimization of the chronological sequences and thus a reduction of the printer downtimes, i.e. of the times during which no printer operation is possible, can be achieved in that the filling of the various developer stations takes place at least partially temporarily parallel or simultaneously. It can, in particular, be provided that each of the developer stations has its own device for monitoring the ageing status of the mixture, for example a counter for counting the pages printed with the mixture, however that a replacement of several developer mixtures simultaneously takes place for all these mixtures as soon as a first mixture has reached its life limit, for example by reaching a predetermined upper counter limit of the page counter. In a further improved embodiment, the simultaneous replacement of a further developer mixture can be made dependent on whether its ageing status has reached a certain minimum level of replacement, for example when its page counter has reached a so-called lower replacement limit which is below the upper counter limit mentioned.

Three phases for generating a developer mixture are in particular: filling carrier, filling toner and mixing.

These phases can be described as follows:

Filling carrier: During this phase, the carrier material—carriers—is filled into the developer station.

Filling toner: The filled-in carrier has no toner. A certain toner concentration must be present to enable printing. In order to achieve this, a newly filled-in mixture is filled with toner. In doing so, a predetermined number of conveying cycles is performed which transport the required amount of toner to the carrier.

Mixing: The carrier and the toner have to be mixed in order to obtain a uniform distribution and to be electrically charged. This charging of the carrier and particularly of the toner is necessary so that the printing process can be performed at all.

For solving the problem, the individual processes "filling carrier" and "filling toner" are implemented at the same time. In particular, the two processes can be coordinated such that first the carrier is filled in and after a defined amount of time the process "filling toner" is started. This amount of time is useful so that already some carrier is present in the developer station before the first toner is added. In particular, both processes end at the same time. The mixing in particular likewise takes place simultaneously to the two other processes. The processes of filling in carrier and toner, which processes are performed in parallel, simultaneously also fulfill the function of the mixing phase. Further, if required, there is the possibility of additionally performing a mixing phase for an arbitrary amount of time by a change in parameters. This possibility is in particular advantageous because in the case of certain toners or carriers, a longer activation may be required.

By means of the parallel running, the individual phases of a mixture preparation, which up to now have strictly been performed one after the other, are interleaved in time, this resulting in a considerable time optimization. The shorter process time results in a smoother handling of the printer and in a shorter waiting time during the change of mixture. In addition, the mixture ages less because it is used for a shorter period of time.

With the preferred embodiment, processes which in methods known up to now have been implemented sequentially are run in parallel for the first time. With a certain delay, which is required, carrier and toner are simultaneously filled in. As a result thereof, the processes can be interleaved in time and the overall process time can be considerably reduced.

The mixing phase for mixing and activating the mixture is also performed in parallel thereto, the joint filling of the developer station being sufficient for activating the mixture formed. Activation means that the toner and the carriers are oppositely charged by the friction during mixing. Should there be mixtures which have other properties and require a longer mixing phase, a separate mixing phase can be provided in the process, which phase can be enabled via a change in parameters when needed.

According to a second aspect of the preferred embodiment, which can be performed in combination with or also independent of the first aspect, a method for the computer-assisted replacement of a developer mixture in a developer station of an electrographic printing device comprises:

(a) a first phase in which a used developer mixture is drained off from the developer station and (b) a second phase in which a new developer mixture is generated in that new carrier and toner are filled into the developer station process step-by-process step or continuously and are thoroughly mixed, the amount of the supplied carrier and/or the supplied toner is automatically acquired regularly, in particular process step-by-process step.

The overall process of the mixture generation is in particular subdivided into phases and predetermined parameters, in particular the amounts of the filled-in materials are acquired during the process. As a result thereof, it is possible in the case of an aborting of the processes during one phase, in particular in the case of an error, to controllably continue the process in this phase. As a result thereof, partially generated mixtures can be finished in a controlled way and do not have to be disposed of.

According to a third aspect of the preferred embodiment, which can be considered alone or also in combination with the aspects mentioned before, in a method for replacing a developer mixture in an electrographic developer station, a continuation at a predetermined process step takes place in the case of an error or an abortion of the process in particular by using the last acquired amount of carrier and/or toner.

The subdivision of the process can, in particular, be effected with the aid of so-called anchor points. The anchor points serve as re-start points at predetermined process steps in case the change of mixture sequence has been interrupted. As a result thereof, not the overall process has to be run again from the beginning, but can be continued in a time saving manner at the respective point. Furthermore, in doing so, a possibly just newly filled in carrier does not have to be drained and disposed of only to enable the restart of the process (with new carrier) from the beginning (which causes additional costs). This form of structuring of the process is particularly advantageous when the process is computer-controlled.

If an error occurs, the process does not have to be repeated completely but will be continued at an anchor point. The anchor points are set at useful and technically feasible points in the process. In order to be able to continue at certain very important points in the change of mixture process, it is necessary to introduce new counters in order to avoid that too much toner is filled into the developer station. These counters are:

1. counters for counting the conveying cycles of a toner transport means during the phase "filling toner". With this counter, it is determined how much toner has already been added to the new carrier particles. As a result thereof, the exact amount of toner which is still missing can be conveyed into the developer station.
2. counters or timers, which monitor the mixing process time wise. These help to rule out that the mixture is mixed too long and thus ages too much or is inadvertently mixed too little, this resulting in considerable print image problems and thus in an error.

Advantages: The "anchor points" result in an even more considerable time saving in case of an error. Furthermore, it is prevented that errors occur in the developer station (e.g. too much toner filled in, ageing too long, mixture charged too low). In addition, in case of an error the carrier and toner already filled in do not have to be removed again and disposed of.

The above-mentioned toner conveying counter is active in particular during the phase of the filling in of the toner into the carrier and counts the number of toner conveying cycles performed. If the process is interrupted during this phase, it is later continued again at this point ("anchor point"). The process continuation at the anchor point is possible because the number of conveying cycles already performed has been counted and the amount of toner already conveyed into the developer station or into the carrier is known. Thus, it is avoided that, for example, too much toner is filled into the developer station.

A corresponding counter for counting mixing cycles can also be set up for the mixing phase. Since the carrier ages during its lifetime, and this factor is processed by the printer, it is advantageous to know the length of the mixing phase and not to expand the same unnecessarily.

According to a third aspect of the preferred embodiment, which can be seen independent of or in combination with one or both of the afore-mentioned aspects, developer mixture relevant status and/or counter data, in particular a full/empty status of the developer station, a phase status which indicates the current phase of the change of mixture or of the mixture generation, and/or the amount and/or time values acquired during generation of the mixture are stored on a non-volatile electric memory of the developer station.

The current status of the developer station—e.g. empty or partially empty—is stored on a non-volatile memory of the developer station itself. The counter readings of the above-described counters are likewise stored on the non-volatile memory. Thus, the information regarding the status of the developer station is no longer only present in the printer but is also stored on the developer station itself. Further, a microprocessor processing these data can be provided in the developer station. On the basis of the data stored thereon, a developer station can at any time, even after an aborted change of mixture can also be used in another printer or at another point in time without risking to get in an error status, for example by way of filling in too much toner. In addition, a new carrier which had already been filled in at the time of abortion of the change of mixture and still has to be filled with toner (partially or completely) can still be used because the developer station recognizes on the basis of the counter reading on the non-volatile memory how much toner has already been filled in. This, too, can take place in another printer because the information on the counter reading and on the status (e.g. "draining") is "taken along" with the developer station.

In the following, the preferred embodiment is described on the basis of a comparison between a conventional printing system (old) and a preferred embodiment printing system from which further effects and advantages of the preferred embodiment become obvious.

In FIG. 1, an electrophotographic printing device for single or multi-color, single or both-sided printing of band-shaped recording media 10 having a different band width is schematically illustrated. As an intermediate carrier, it includes a photoconductor drum 11 driven by an electric motor. Around the intermediate carrier 11, the various aggregates for the electrophotographic process are grouped. Basically, these are a charging device 12 in the form of a charging corotron for charging the intermediate carrier 11; a character generator 13 having a light emitting diode comb for the character-dependent exposure of the intermediate carrier 11 which comb extends over the entire useful width of the intermediate carrier 11; a developer station 14 for inking the character-dependent charge image on the intermediate carrier 11 with the aid of a one-component or a two-component developer mixture; a transfer-printing station 15 which extends over the width of the intermediate carrier 11 and with which the toner images are transferred onto the recording medium 10. For removing the residual toner after developing and transfer-printing, a cleaning station 16 is provided having an integrated cleaning brush with associated suction device as well as a discharge device 17. The intermediate carrier 11 is driven by an electric motor and is moved in the arrow direction during printing.

Further, the printing device comprises a fixing station 18 which is arranged downstream of the transfer-printing station 15 in a transport direction of the recording medium, which fixing station is formed as a thermal printing fixing station, as well as a feed device 21 arranged downstream of the fixing station and having guide rollers for feeding the recording medium 10 to an internal stacking device 22 or to an external stacking device or another post-processing device arranged outside the printing device.

The band-shaped recording medium 10 is, for example, mass-produced as fan-fold paper having a marginal perforation and is fed from an internal supply stack 23 via feed rollers 24 to a paper separation device of the transfer-printing station 15, which paper separation device can be swiveled away. However, it is likewise possible to feed a recording medium without marginal perforation vie a roller feed mechanism.

The transport of the recording medium 10 preferably takes place via a transport device 25 assigned to the transfer-printing station 15 and being formed as transport belts provided with pins which engage with the marginal perforation of the recording medium 10 via drive rollers. Further, in the housing area of the printing device, and in fact in the receiving area for the internal supply stack 23, a turn-over device 28 is arranged, via which the recording medium already printed on the front is turned over for printing on the back side and is re-supplied to the transfer-printing station 15. The turn-over device 28 communicates with the fixing station 18 via a feed-back channel 29.

Basically, the units in the illustrated printing device are combined to form replaceable modules or are formed as replaceable modules. This applies to the turn-over device 28, the feed-back channel 29, as well as to the electrophotographic printing module 26 together with the aggregates for the electrophotographic process arranged thereat. The developer station 14 can be separately replaced in the electrophotographic printing module 26. For this purpose it is mounted on rails 27 and can thus be moved, perpendicular to the drawing plane, out of the printing device and can be replaced. The basic structure of the developer station is known from WO-A1-98/27472, which is herewith incorporated by reference into the present application. On the developer station 14, an identification arrangement 30 in the form of a flat assembly is arranged, the function of which will be explained further below. Further, the developer station comprises an automatically controlled mixing excavator, with which the toner developer mixture can be thoroughly mixed.

The printing device is controlled by means of a printer control (not illustrated). The operation of the printing device is performed via a control panel display 31 in the form of a touch screen.

Figure 2:
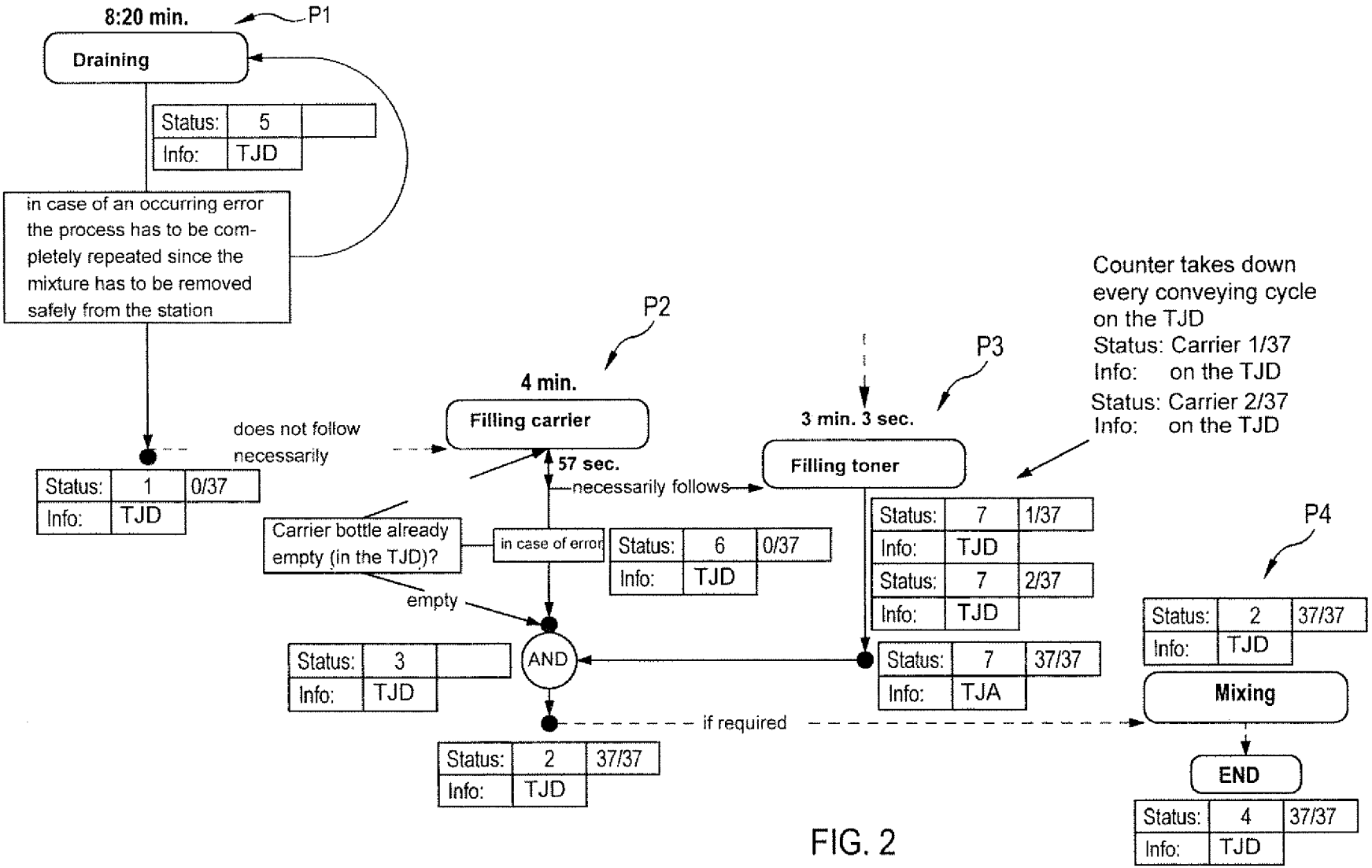
FIG. 2 shows relationships during the change of a developer mixture.

The identification arrangement 30 mounted on the developer station 14 can be comprised of several electronic modules arranged on a circuit board, which modules are connected to one another via control lines to form a microprocessor control and are described in more detail in EP-B1-1 016 935 (FIG. 2). The variable data on the status or the properties of the developer station are stored in a non-volatile semiconductor memory, in particular a transponder memory.

In the developer station 14, several inductively and analogously operating toner concentration sensors as well as one or several temperature sensors are arranged. The toner concentration sensors inductively determine the ratio of the carrier particles comprised of iron to the toner particles of the developer mixture while taking into account the ambient temperature and the sheet counter reading and possibly taking into account other influencing data. In doing so, the need for fresh toner is determined and is communicated to the device control. The latter operates the corresponding fresh toner supply device in the apparatus.

When a change of mixture is to be performed in the developer station 14, a corresponding software program is started via the control panel 31, which program controls the process in a computer-assisted manner. As soon as the process of draining the mixture is started, the developer station has to be drained off completely because otherwise the required filling level (with mixture/carrier) is no longer guaranteed. This status is stored in the semiconductor memory mounted on the developer station 14 with "not full" (or respectively draining).

Altogether, the developer station which operates in the following examples according to the tribo jump principle and is also referred to hereinafter as TJD, can be assigned the following statuses, the respective digit being stored as a numerical value in the semiconductor memory:

1 empty; 2 not full; 5 draining; 6 filling carrier; 3 full with carrier; 7 filling toner; 4 full with developer; 8 expired; 0 undefined.

In FIG. 2, four partial processes of a change of mixture process and their relations to one another are shown, namely P1 "draining", P2 "filling carrier", P3 "filling toner" and P4 "mixing". Additionally, the respective process time is given.

In the associated tables corresponding data is given which is stored in the semiconductor memory of the developer station, e.g. the status value 5 when running through the partial process "draining".

The superordinated process control (software) is set such that the overall process can be interrupted when process P1 is completed, i.e. P2 does not necessarily follow after P1. On the other hand, process P3 (filling toner) is necessarily started automatically after a predetermined amount of time (57 sec) after process P2 (filling carrier) was started. Since the process "filling carrier" usually takes four minutes and the process "filling toner" takes 3 minutes and 3 seconds, the two processes are usually completed at the same time. In this embodiment, the filling in of toner takes place in 37 partial steps, each partial step being stored in a counter on the developer station so that in case of an aborting or an error during the filling in of toner the still required residual amount of toner can be determined later on and can be filled in. When an error occurs in the process "filling toner" or when it is aborted, then it will automatically be continued later on at the point at which it has been interrupted. For this purpose, the value of the toner counter stored last on the developer station is read out, and the residual need for toner conveying cycles is determined in the printer. In the case of an error occurring during the filling in of carrier, it is queried (automatically or partially automatically) whether the carrier bottle is already empty. Possibly toward the end of the partial process, one proceeds to an AND junction at which the end of the partial process "filling toner" is waited for. If the carrier bottle is not empty yet, the carrier filling process is continued or re-started.

After completion of the filling in of toner, additionally the mixing process P4 can be started, this start and/or the duration of the mixing process P4 can be manually initiated or can be automatically set on demand after measurement of the mixture properties or also firmly set station-individually or device-individually.

In the following figures, various steps are referred to and structured as follows:

GG(i): steps for draining the developer mixture,

F(i): error status/error message,

W(i): alarm message,

GE(i): steps for filling in developer particles,

GM(i): steps for filling in toner into the mixture/mixing, wherein i represents a natural number each.

Further, in FIGS. 3 to 6, flow charts are illustrated in which method steps are given in three columns each. The medium column has a bright background and describes method steps which are performed machine internal in the developer station and/or in the device control of the printing device. The column to the left of the middle column has a slightly shaded background and in particular represents interface method steps which are supported by the control panel of the printing device which in particular comprises a display device (screen), input means (touch screen, switch) and a control panel software. The column to the right of the middle column mainly represents steps for device-internal error and alarm messages as well as driving steps for one or more light emitting diodes present on the developer station.

Figure 3A:
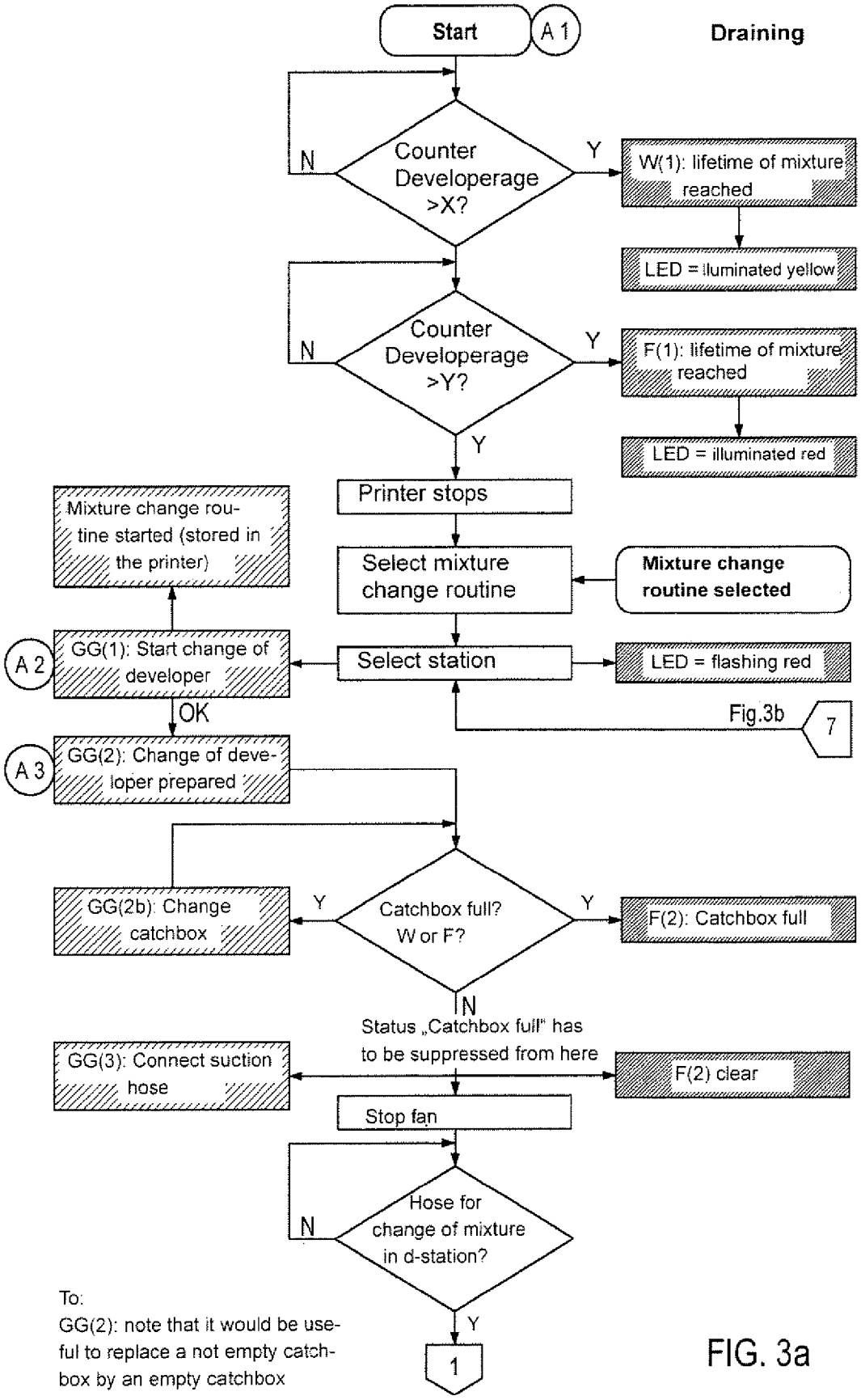
FIGS. 3*a* and 3*b* show a process of draining the mixture.
Figure 3B:
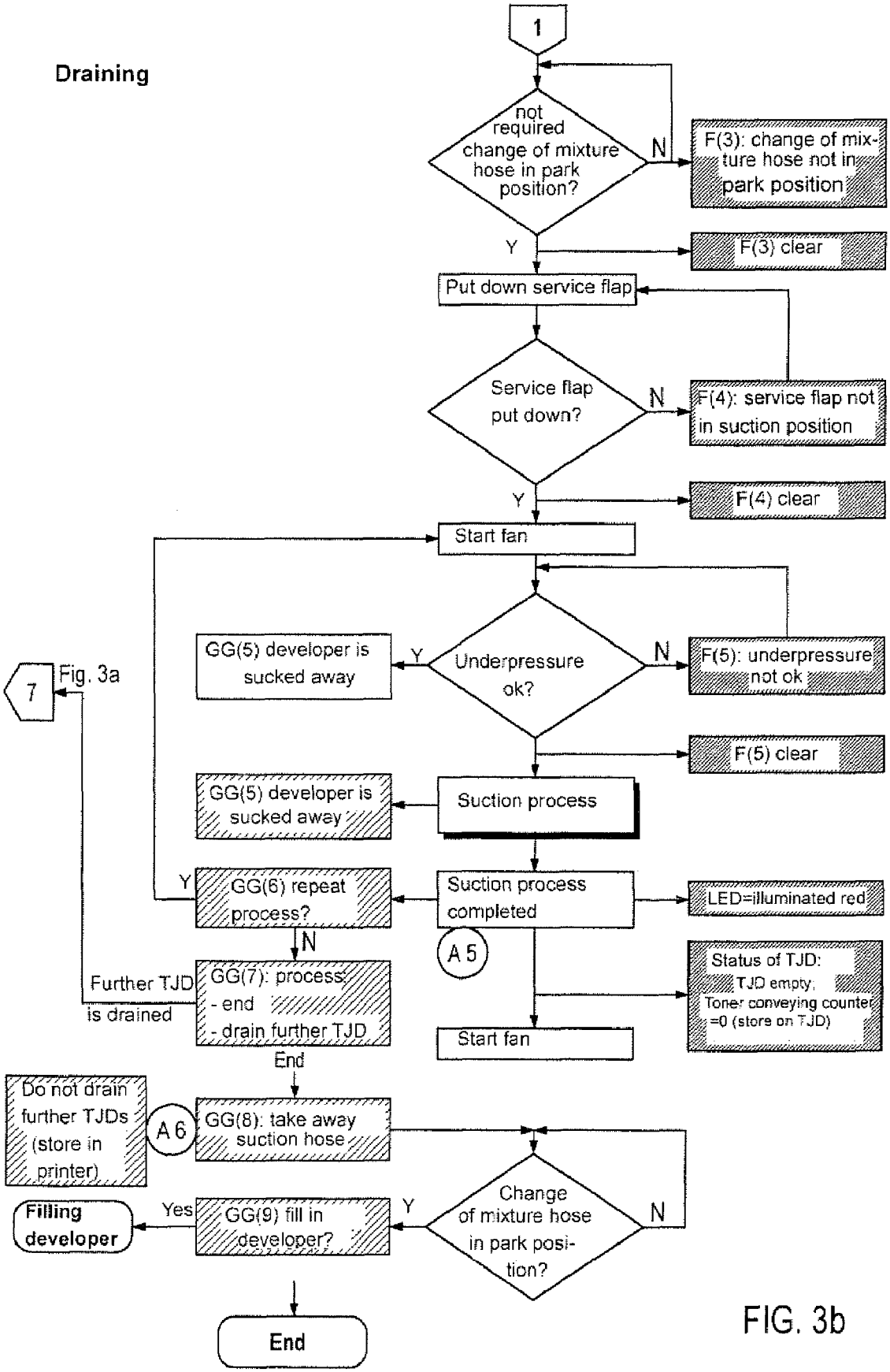
Figure 4:
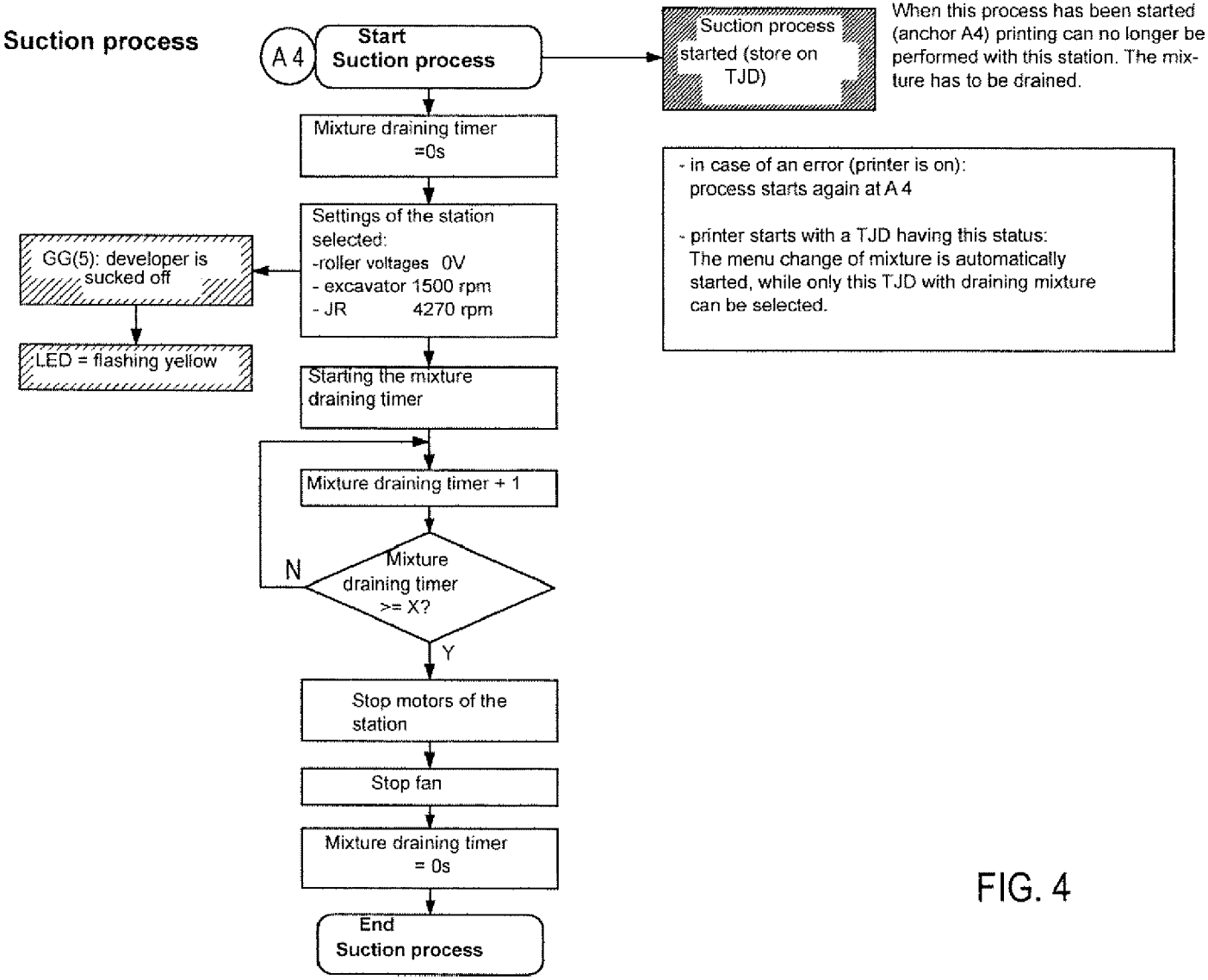
FIG. 4 shows a partial process of the suction operation.

In FIGS. 3*a*, 3*b* and 4, the software-wise controlled process P1 "draining" is illustrated in detail, which process is supported by a corresponding software program. Printer-side settings or statuses which are performed by actuators or are acquired by sensors, are also taken into account, e.g. underpressure and fan statuses, service flap settings, door positions, roller voltages etc. The process has five anchor points A1, A2, A3, A4 and A5, at each of which the process can be continued if it has been aborted at a position after the anchor point and the following anchor point. The device control software and the control panel software are provided with corresponding means to support the return to anchor points. In the left-hand column, the control panel steps can be found, the middle column represents the developer station-specific method steps, and in the right-hand column 37 the alarm messages and the light-emitting diode (LED) drivers are shown.

The catchbox is a container in which used developer particles and/or toner is filled. Light emitting diodes which are mounted on the developer station and/or are displayed on a control panel indicate certain operating conditions of the TJD by means of corresponding color displays. A service flap represents a switch for switching on the underpressure in the suction hose of the developer station, provided that the fan at the developer station is switched on. The developer station is in particular a so-called toner jump developer station (TJD) having a jump roller (JR).

Figure 5A:
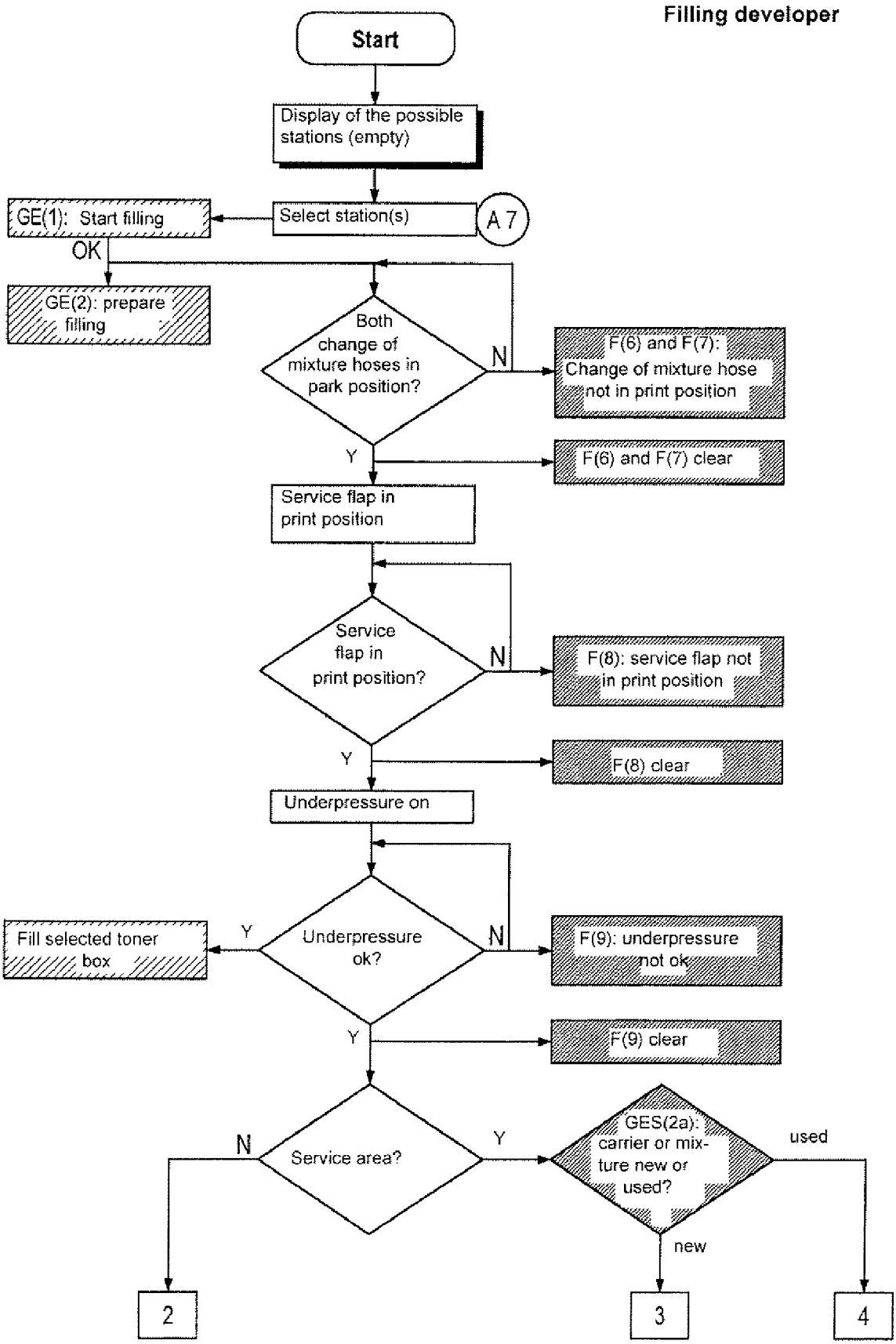
FIGS. 5*a* and 5*b* show a process for filling in carriers.
Figure 5B:
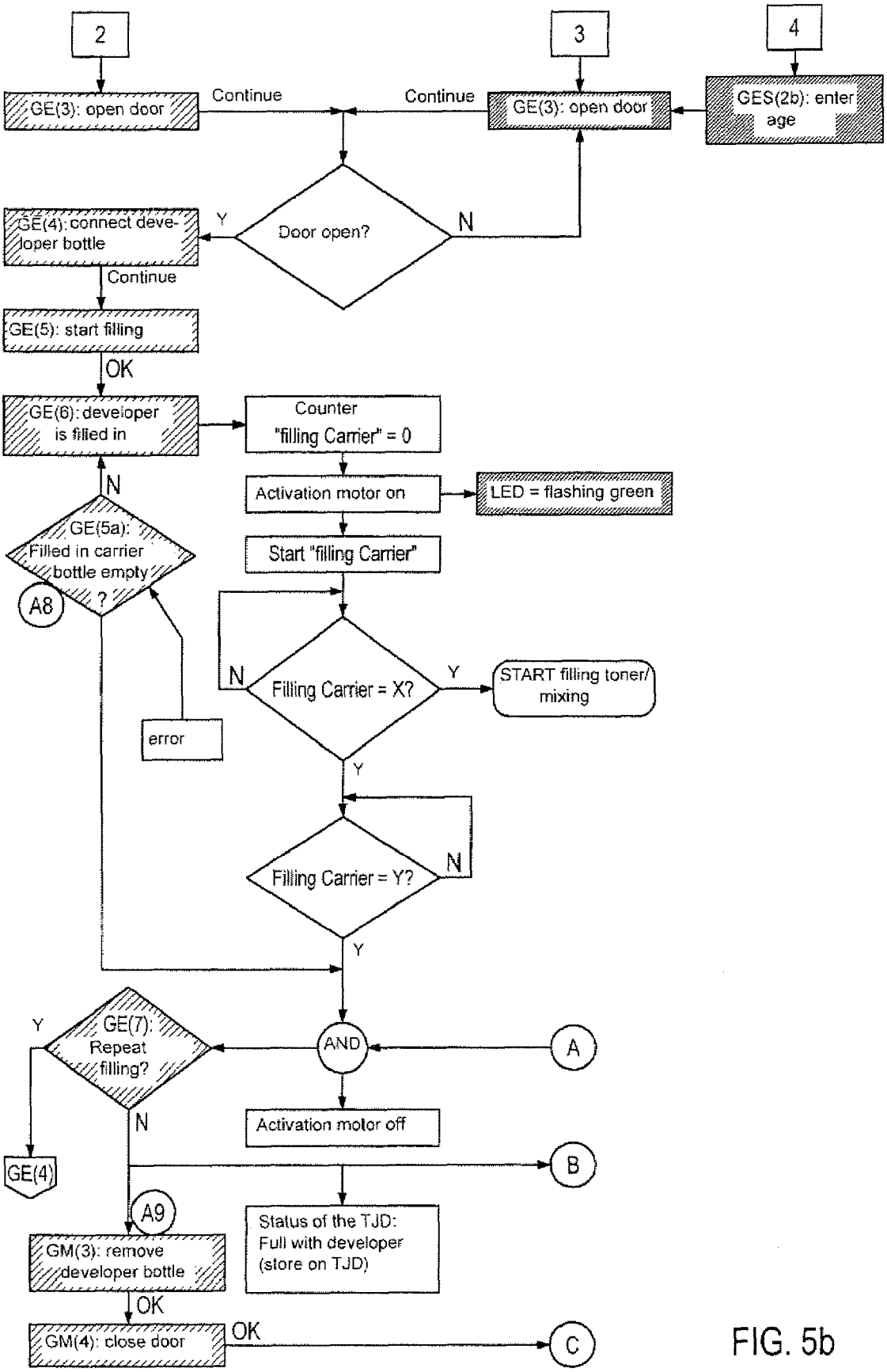
Figure 6A:
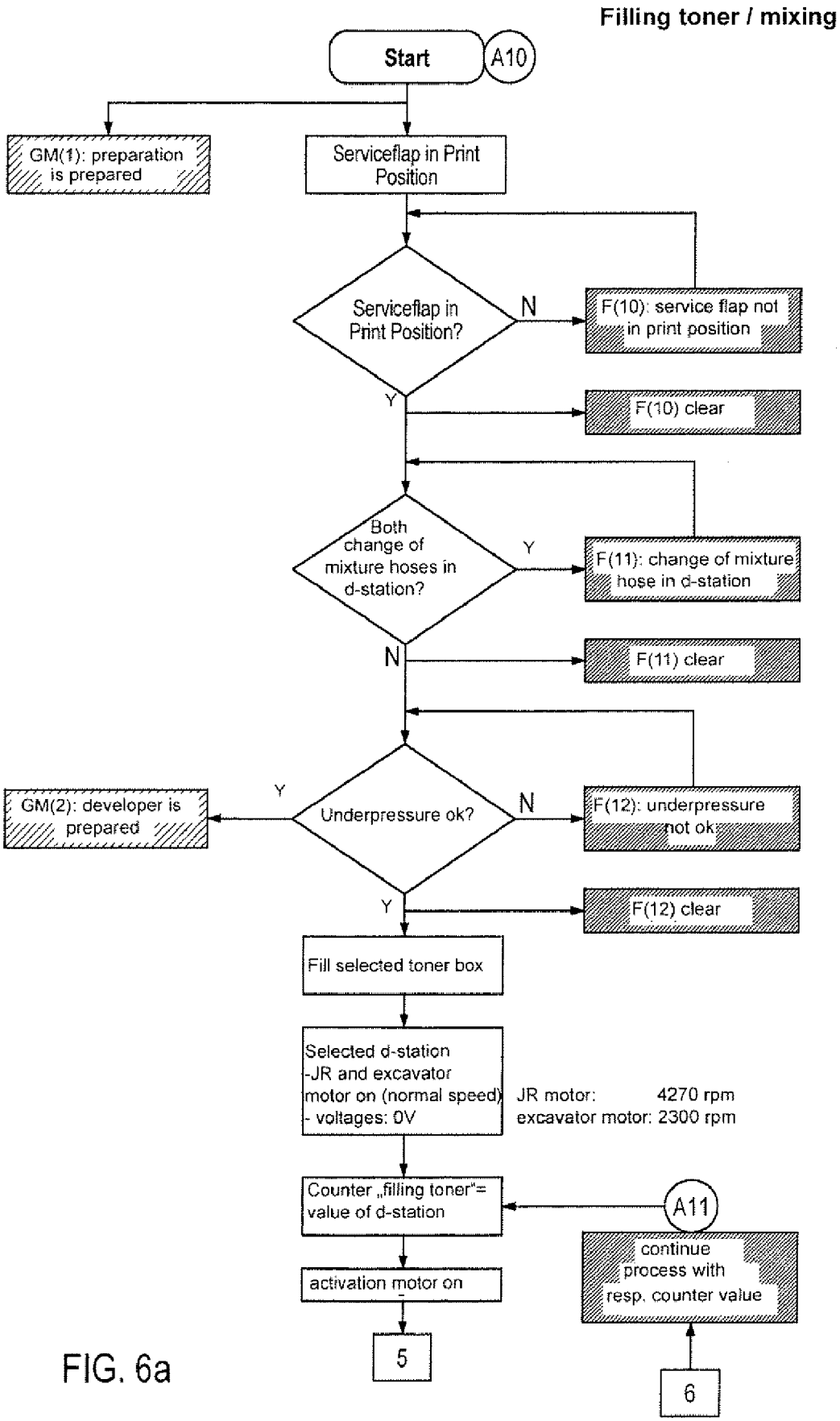
FIGS. 6*a* and 6*b* show processes for filling in toner and for mixing.
Figure 6B:
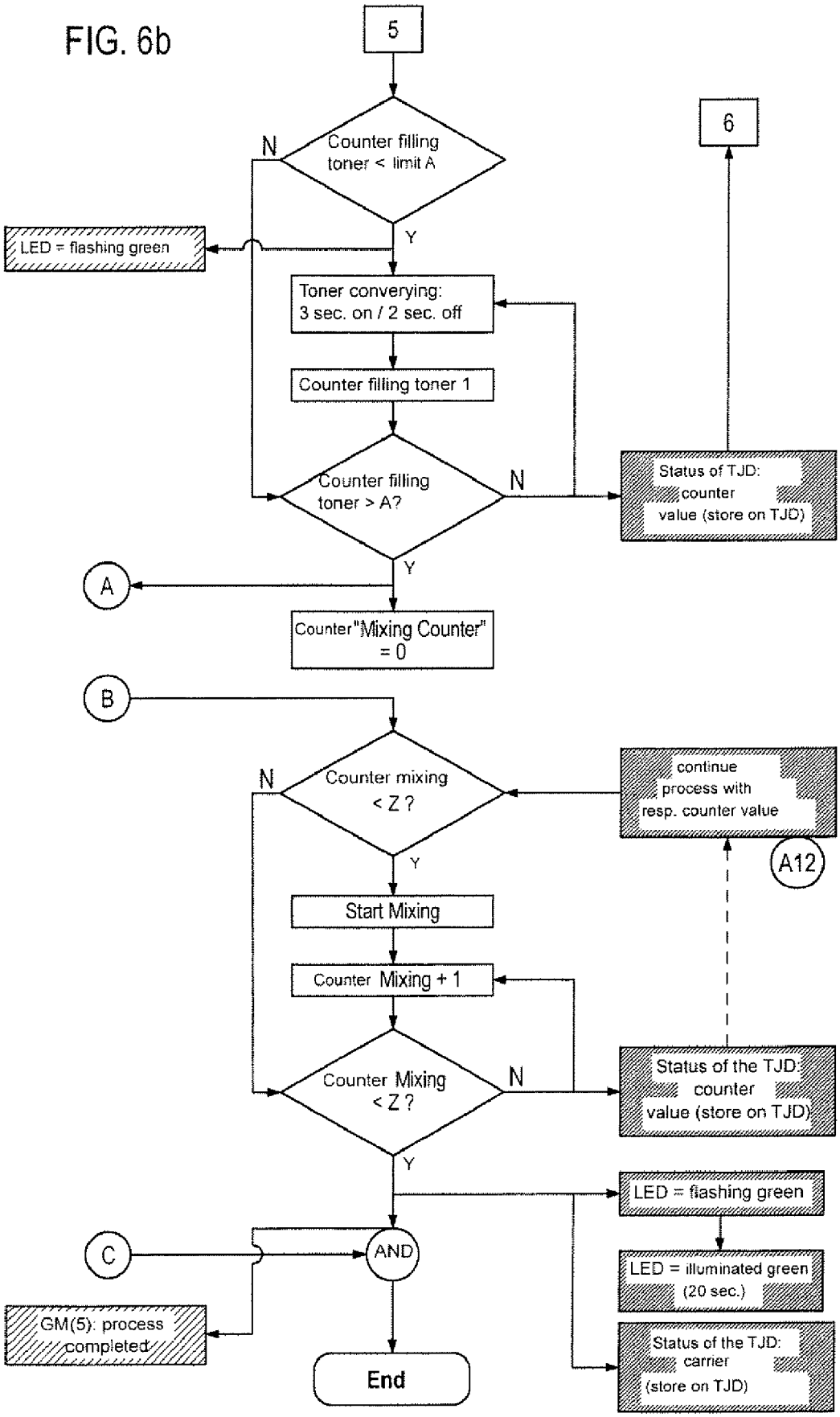

In FIG. 5, the process "filling carrier" is illustrated and in FIG. 6, the process "filling toner and possibly mixing" is illustrated. The partial process "filling developer" has three anchor points, A7 when selecting the station, A8 for the verification in case of an error, whether the carrier bottle is empty and A9 upon removal of the developer bottle. The partial process "filling toner" has the two anchor points A10 at the start and A11 for continuation of the process with the respective counter reading. The phase "mixing" has an anchor point A12 upon continuation of the process with a corresponding counter reading. As mentioned at the beginning, the process "mixing" (restart at point B of FIG. 6) is optional depending on the device or the developer station and can depend on the set or selected counter value Z remain unperformed (Z=0) or can be repeatedly performed with Z>0 mixing steps. The steps/queries GES(2a) "carrier or mixture new or used?" GES(2b) "insert age" and GE(3) "open door" are displayed on the control panel and possibly entered.

In the following, the improvement achieved with the preferred embodiment is described on the basis of a comparison with printing systems available up to now.

1. Cause of Optimization

In a conventional high-performance printing system, the change of mixture is a relatively lengthy matter and, with about 30 min per developer station, typically represents a considerable downtime during printing. This is particularly considerable if the printing device such as the printing system Océ Variostream 9000 developed by the applicant comprises several (up to 1) developer stations. In addition, when an error has occurred possibly the entire change of mixture process has to be repeated from the beginning. For this purpose, it is further required on top of that that a possibly already filled-in carrier has to be drained again. In addition, the drained carrier often has to be disposed of although it is unused.

2. Objective

The change of mixture is to be improved, while the following points should be met:

- time-optimized change of mixture in the good case and in the error case
- continuation of the change of mixture after an interruption, e.g. due to an error
- the status of the developer station shall be recognizable 3. General Information A change of mixture is a so-called special function. Special functions are functions which are beyond the "normal" printing operation.

4. Improvements in General 4.1 Status of the Developer Station

The status of the developer station is stored on a non-volatile memory in the developer station itself. When the change of mixture is interrupted (intentionally or unintentionally), it can start again at the respective point and finish the process. This is even possible when the developer station is inserted in another printer and/or the station is used at a later point in time. Carrier that is possibly already filled in does not have to be drained again because the process does not have to start completely at the beginning. For the same reason, the change of mixture is shortened in case of an error.

The possible statuses of the developer station stored on the non-volatile memory of the developer station are:

| | | | |
|---|---|---|---|
| 1 | corresponds to | empty | The mixture is drained, the developer station is empty. |
| 2 | corresponds to | not full | Both carrier and toner are in the developer station, which are, however, only considered as developer (mixture) after mixing. |
| 3 | corresponds to | full with carrier | Carrier is present in the developer station. |
| 4 | corresponds to | full with developer | Carrier and toner are present in the developer station and the mixing process is completed. Thus, there is developer (mixture) in the developer station. |
| 5 | corresponds to | draining | At the moment, the developer station is drained or, respectively has been interrupted during draining. |
| 6 | corresponds to | filling carrier | At the moment, carrier is filled into the developer station, or there has been an interruption during the filling in of carrier. |
| 7 | corresponds to | filling toner | At the moment, toner is filled into the developer station or there has been an interruption during the filling in of toner. |

-continued

| | | | |
|---|---|---|---|
| 8 | corresponds to | expired | The mixture present in the developer station has reached the end of its lifetime. |
| 0 | corresponds to | undefined | The developer station is in an undefined status. |

The listed statuses of the developer stations are not only important when the mixture is changed. They are important whenever a station is inserted into a printer or the printer is turned on. In these cases, the developer stations inserted are queried so that the printer determines whether it is in a condition ready for printing or not. The printer will react accordingly and enables the printing operation or "forces" the operator to finish a possibly interrupted process (change of mixture).

4.2 Change of Mixture Counter

Besides the statuses described under item 4.1, there is still further information on the developer station which is, however, exclusively important for the change of mixture. These are two counters which provide that respective procedures during the change of mixture are precisely complied with in order to avoid serious errors. Furthermore, they guarantee that even in case of an abortion of the change of mixture during a "critical" phase the process can be continued at the respective point. The counters are:

- a counter for counting the conveying cycles during the filling in of toner:
  - it provides that the exact amount of toner is conveyed into the developer station.
- a counter for counting the mixing time:
  - it provides that carrier and toner are exactly mixed for the predetermined time.

Without the counters described herein, possibly too much toner could be filled in or one could obtain a qualitatively bad printing result owing to a mixture that is not sufficiently charged.

4.3 Anchor Points

Anchor points are points during the change of mixture which are considered as re-start points. That means that an interrupted change of mixture does not have to be repeated completely from the beginning but only "falls" back to the last anchor point and finishes the procedure starting out from this point.

The anchor points are set at useful and technically feasible points in the operational sequence and thus reduce the process time of the change of mixture in case of an error or in case of interruptions.

The counters listed under item 4.2 are to be mentioned as particularly important anchor points and provide, for example, that the precisely required amount of toner is conveyed into the developer station.

4.4 Parallelization

Up to now, the four phases of which a change of mixture comprises have all been serially run through. In order to reduce the process time, some phases of the optimized change of mixture are run in parallel. These are the partial processes "filling carrier", "filling toner" and to some extent also "mixing". Particularly the parallelization of the two phases "filling carrier" and "filling toner" results in a considerable reduction in time.

For implementation of this technique, the two processes are coordinated. Since it is necessary that there is already some carrier in the developer station before toner is supplied, the filling in of the toner starts a bit later than the filling in of the carrier. In addition, the two processes are varied such that they end approximately at the same time in order to achieve a maximum of time-wise optimization.

An extra mixing phase, as present up to now, is currently not necessary because by means of the parallel feed of carrier and toner, the two materials are already sufficiently mixed. Thus, the mixing is also implemented at the same time. However, it is not excluded that, if required, an additional separate mixing phase is implemented.

5. Improvements in the Flow

The change of mixture comprises of four phases:

draining filling carrier filling toner mixing (or activating)

The individual phases are explained in detail and the respective advantages or improvements are explained.

5.1 Step 1: Draining

| | | |
|---|---|---|
| Process time: | now | 8:20 min |
| | before | 8:20 min |

General Information:

In the first phase of the change of mixture, the mixture present in the developer station is drained. Compared to the change of mixture performed up to now, this step cannot be reduced in time because it has to be ensured that the entire material present in the developer station is sucked off (up to a residual amount of some hundreds of grams that cannot be removed). As soon as the suction process is started, the developer station is placed in the status "draining". This means that the suction process has been started and the initial amount of mixture is no longer present in the developer station. This provides no information on how much mixture is still in the developer station or has been drained. In case this procedure is interrupted or stopped, it is impossible to print with this station because the status "draining" does not allow to do so. Even if the developer station were inserted in another printer of the same type, this status is recognized because the information is stored on the developer station.

When the entire mixture has been drained, the station is placed in the status "empty". In this status, the process "filling carrier" can be started, however, this step does not necessarily have to follow. The process can also be completed because the developer station has, for example, been emptied for transport.

Error Case:

Should an error occur during draining of the mixture or should the procedure be interrupted, the entire process has to be repeated. The reason for this is the risk that is born by a developer station which is not completely emptied and not recognized as such. The use of such a developer station could even result in a total failure thereof. Therefore, for the first partial step of the change of mixture—the "draining"—no counter or timer is inserted in order to continue at a respective point but the entire partial step has to be repeated in order to guarantee that the entire mixture is emptied.

5.2 Step 2: Filling Carrier

| | | |
|---|---|---|
| Process time: | now | 4:00 min |
| | before | 5:00 min |

General Information:

During this phase of the change of mixture, carrier is filled into the empty developer station. The developer slides, only driven by gravity, through a hose into the developer station. As soon as the process is started, the developer station is placed in the status "filling carrier". When the process is finished, a query is made as to whether the entire carrier has slid from the bottle into the developer station. If this query is confirmed yes, the developer station is placed in the status "full with carrier", if confirmed no, the filling operation is repeated. Usually, however, there should be enough time for filling in the entire carrier. The time actually required until the carrier has run out of the bottle into the developer station amounts to approximately two minutes. As a result, the process time itself is reduced from five to four minutes.

Error Case:

When the process is interrupted, a query will be made as to whether the entire carrier has run into the developer station, i.e. whether the carrier bottle is empty. Accordingly, the filling process is completed or repeated.

5.3 Step 3: Filling Toner

| | | |
|---|---|---|
| Process time: | now | 3:03 min |
| | The partial step is implemented in parallel to "filling carrier". Thus, the estimated time for this process step in the overall process amounts to: | |
| | now | 0:00 min |
| | before | 4:51 min |

Conveying cycle: 37 conveying cycles have to take place with the following pattern:

| | |
|---|---|
| now | 3 seconds conveying/2 seconds break |
| before | 3 seconds conveying/5 seconds break |

General Information:

The toner has to be supplied to the carrier in such an amount that 6.4% toner is present. This requires 37 conveying cycles. The conveying cycles are counted and continuously stored on the developer station.

The partial step "filling toner" is implemented in parallel to "filling carrier", which has not been done up to now. What is important is that there is already some carrier in the developer station before the toner is supplied because then both elements mix in a better way. For this reason, the filling in of toner starts a bit later (57 seconds) than the filling in of the carrier. The time of 57 seconds between the beginning of the two phases—"filling carrier" and "filling toner" is moreover useful since both phases are completed at the same time.

Error Case:

If an error occurs during "filling toner" or if the process is stopped, the operation is continued exactly at that point where it has been interrupted. Since the number of conveying cycles already implemented is stored on the developer station, it is known how many cycles still have to be implemented. A filling in of too much or too little toner is thus ruled out.

5.4 Step 4: Mixing

| | | |
|---|---|---|
| Process time: | now | 0:00 min |
| | before | 5:00 min |

General Information:

During the mixing phase the carrier and the toner are mixed. As a result of the occurring frictional resistance, the two materials are charged, i.e. activated. Furthermore, the two materials mix with one another. The charging of the toner and of the carrier is important because printing can only take place with a sufficiently activated mixture.

Up to now a mixing phase of 5:00 min took place for activation. As a result of the new simultaneous filling in of carrier and toner a thorough mixing is already achieved during the phases "filling carrier" and "filling toner". The mixing during these phases is sufficient in order to achieve the necessary activation. Thus, the time of the mixing phase is reduced to 0:00 min. However, the mixing phase is present as a process and can be activated at any time, if required. For this, the respective parameter which indicates the duration of the mixing phase has to be set to the desired time. If the parameter is higher than zero, the mixing phase inevitably follows after "filling carrier" and "filling toner".

Error Case:

If an error occurs during the mixing phase or if the process is stopped, the process is continued exactly at that point where it has been interrupted. In order to make this possible, the time, for which the two materials have already been mixed, is continuously stored on the developer station. After an interruption, one falls back on the counter or timer of the developer station. This way of proceeding is analogous to the way of proceeding when an error occurs during the filling in of toner.

5.5 Time Comparison Between the Change of Mixture Before and Now

As a result of the parallelization and the reduction of the individual steps of the change of mixture, the following overall process time results:

| | |
|---|---|
| change of mixture now: | 12:20 min |
| change of mixture before: | 23:11 min |

Possibly a mixing time has to be added. This, however, is basically not provided and thus shall only be initiated given corresponding knowledge of a special case or in case of generally changed conditions.

Figure 7:
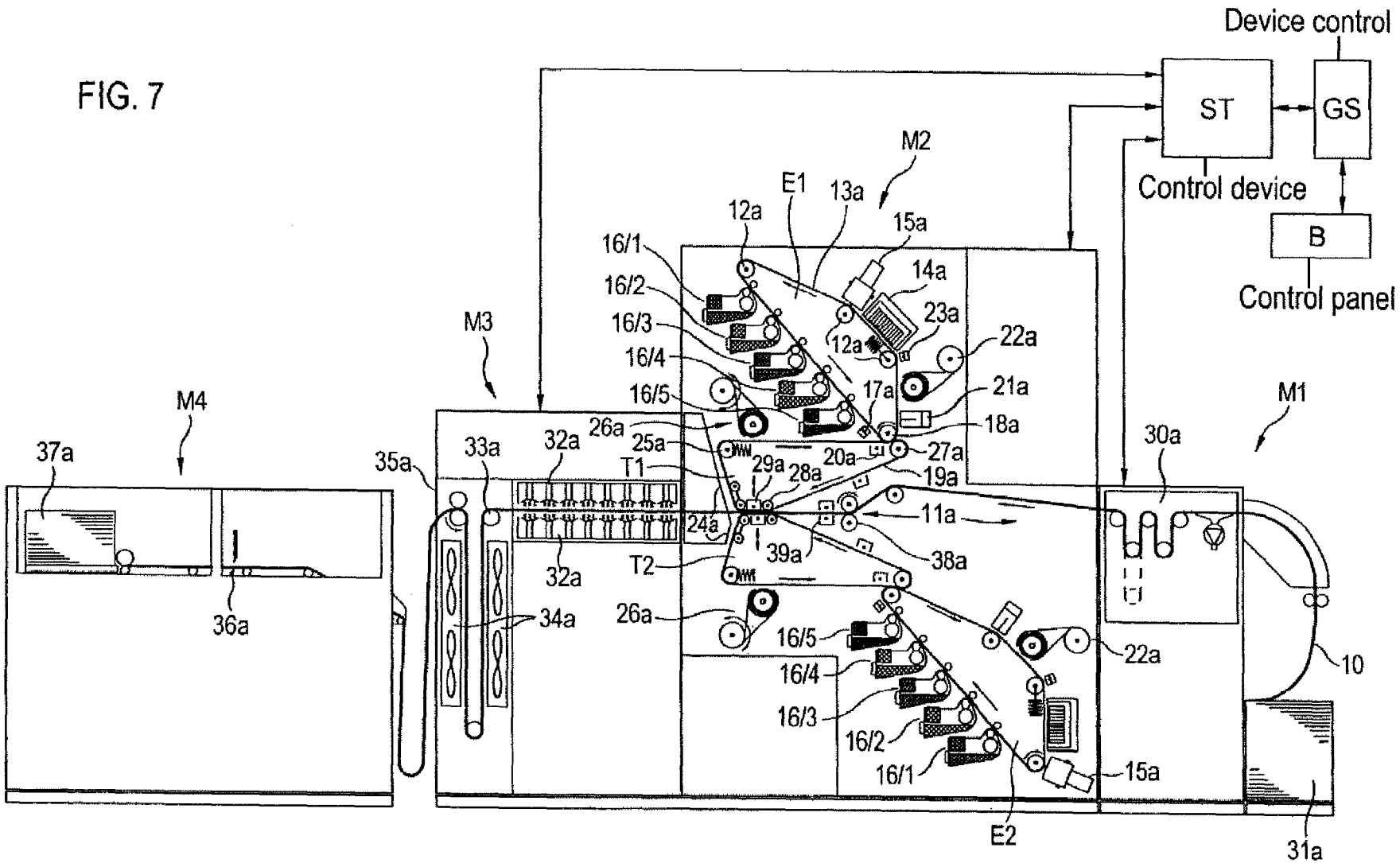
FIG. 7 shows an electrophotographic printing device comprising several developer stations.

In FIG. 7, a printing device having several developer stations is illustrated, which are optionally provided for printing with different colors and/or for a printing on both sides of a recording medium. It is, in particular, provided with features known from WO-A1-98/39691 and WO-A1-98/27466, the contents of which are herewith incorporated once again by reference into the present specification. With the present preferred embodiment is then particularly possible to change the developer mixtures of several developer stations in parallel or completely or at least partially simultaneously.

The printing device illustrated in FIG. 7 and used for performance-adapted monochrome and/or colored, one-sided or two-sided printing of a band-shaped recording medium is composed of modules and basically has a feed module M1, a printing module M2, a fixing module M3 and a post-processing module M4. The feed module M1 includes the elements for feeding fan-fold paper, for example, withdrawn from a stacker, to the printing module M2. The printing module M2 includes the actual electrophotographic printing aggregates which print the recording medium which then will be fixed in the fixing module M3 and cut or stacked in the post-processing module M4.

The Modules in Detail:

The printing module M2 comprises the aggregates required for printing toner images on a band-shaped recording medium 10, which aggregates are arranged on both sides of a transport channel 11*a* for the recording medium 10. These aggregates substantially are comprised of two different configurable electrophotography modules E1 and E2 with associated transfer modules T1 and T2. The modules E1 and T1 are assigned to the front side of the recording medium 10 and the modules E2 and T2 to the rear side. The identically structured electrophotography modules E1 and E2 include a photoconductor belt 13*a*, e.g. an organic photoconductor (OPE) guided over deflection rollers 12*a* and driven by an electric motor in arrow direction. Along the light-sensitive outer side, the aggregates for the electrophotography process are arranged. They serve to generate toner images on the photoconductor which are assigned to individual color separations. For this purpose, the photoconductor moved in arrow direction is first charged with the aid of a charging device 14*a* to a voltage of about −600 V and then discharged in a character-dependent way with the aid of a character generator 15*a* comprising a light-emitting diode comb (LED comb) to about −50 Volt. The latent charge image generated in this way and present on the photoconductor is then inked with toner with the aid of the developer stations 16/1 through 16/5 and afterwards the image is "loosened" with the aid of the intermediate exposure unit 17*a* and transferred in a transfer-printing region 18*a* onto a transfer belt 19*a* of the transfer belt module T1 with the aid of a transfer corona device 20*a*. Subsequently, the entire photoconductor belt is discharged over the entire width with the aid of the discharge corona device 21*a* and cleaned with the aid of a cleaning device 22*a* having a cleaning brush from toner powder adhering thereto. An intermediate exposure device 23*a* arranged downstream provides for a corresponding charge-wise conditioning of the photoconductor belt 13*a* which then, as already described, is uniformly charged with the aid of the charging device 14*a*.

With the electrophotography module E1 or E2 toner images are generated which are assigned to individual color separations of the color image to be generated. For this purpose, the developer stations 16/1 through 16/5 are designed in a switchable fashion. Each of the developer stations contains a toner assigned to a single color separation. For example, the developer station 16/1 includes black toner, the developer station 16/2 includes toner of the color yellow, the developer station 16/3 includes toner of the color magenta, the developer station 16/4 includes toner of the color cyan and, for example, the developer station 16/5 includes blue toner or toner having a special color. One-component toner as well as two-component toner developer stations can be used as developer stations.

During operation of the printing device each of the developer stations 16/1 through 16/5 generates one toner image each that is associated to a single color separation. This toner image is then electrostatically transferred via the transfer-printing device 18*a* in connection with the transfer corona device 20*a* onto the transfer belt 19*a* of the transfer module T1. The transfer module T1 includes the transfer belt 19*a* which is comprised of polyimide or a similar substance and is guided about several deflection rollers and driven by a motor. Similar to the photoconductor belt 13*a*, the transfer belt 19*a* has an endless form and no seam. It is moved in the arrow direction, starting out from the transfer region comprising the roller 18*a* and the transfer corona device 20*a* to a transfer printing station 24*a* and from there further around a deflection roller 25*a* to a cleaning station 26*a* and from there again to the transfer region 18*a*, 20*a* with the deflection roller 27*a* arranged thereat.

The transfer belt 19*a* in the transfer module T1 functions as a collector for the individual toner images which are assigned to the color separations and which are transferred onto the transfer belt 19*a* via the transfer device 18*a*, 20*a*. The individual toner images are arranged on top of one another so that an overall toner image is created which corresponds to the color image. In order to be able to generate the overall color toner image and in order to transfer the same onto the front side of the recording medium 10, the transfer module T1 includes a switchable transfer printing station 24*a*. According to the representation of FIG. 7, the same can comprise several mechanically slidable transfer-printing rollers 28*a* together with an associated transfer printing corona device 29*a*. In the operating state "collecting", the transfer printing rollers 28*a* and the transfer printing corona device 29*a* are respectively slided upward in the arrow direction, so that the transfer belt 19*a* is spaced to the recording medium 10*a*. In this condition, the individual toner images are taken over from the electrophotography module E1 and are superimposed on the transfer belt 19*a*. The cleaning station 26*a* is deactivated in that it is swiveled away. In this operating state, the recording medium 10 is at rest in the area of the transfer printing station 24*a*.

The electrophotography module E2 and the transfer module T2 for the rear side of the recording medium 10 are structured in accordance with the modules E1 and T1. Here, too, a collective color toner image for the rear side is generated on the transfer belt T2, and here, too, the corresponding transfer printing station 24*a* is swiveled away in the operating state "collecting".

For simultaneous printing on the front and rear side of the recording medium 10*a*, the transfer belts 19*a* of the transfer modules T1 and T2 are simultaneously brought into contact with the recording medium 10 in the area of their transfer printing stations 24*a* and the recording medium 10 is moved. At the same time, the cleaning stations 26*a* of the transfer modules T1 and T2 are swiveled thereto and activated. After transfer of the two toner images onto the front and the rear side of the recording medium 10*a*, toner image residuals adhering to the transfer belts 19*a* are removed via the cleaning stations 26*a*. Thereafter follows another collecting cycle for generating new toner images, during which the transfer belts 19*a* are swiveled away and the recording medium 10 is at a standstill. The transfer of the toner images from the transfer modules T1 and T2 onto the recording medium 10 thus takes place in the start-stop-operation of the recording medium.

The recording medium 10 is moved in the feed module M1 from a stack device 31*a* via a looper 30*a* to the printing module M2 and there in the paper transport channel 11*a* with the aid of motor-driven transport rollers 38*a*. In the area between the transport rollers 38*a* and the transfer-printing stations 24*a*, charging or corona devices 39*a* for paper conditioning can be arranged, so that the band of recording medium 10 made of paper is, for example, uniformly charged before transfer printing.

After the transfer-printing of the two color toner images onto the recording medium 10 in the area of the transfer printing stations 24*a*, these still have to be fixed. The fixing module M3 serves this purpose. It contains an upper and lower row of infrared radiators 32*a* between which the paper transport channel for the recording medium 10 extends. Since a "loose" toner image is present on both the front side and the rear side of the recording medium, the recording medium 10 is freely guided contact-free in the area of the infrared radiators 32*a* via a deflection roller 33*a* arranged on the output side. The fixing is effected by means of the heat of the infrared radiators 32*a*. In a cooling path following the infrared radiators 32*a* and comprising cooling elements 34*a* and deflection rollers 35*a*, a cooling down of the recording medium 10 as well as a smoothing, for example, via corresponding decurling devices, takes place. Fan-operated air chambers can, in particular, serve as cooling elements 34*a*.

After fixing the two toner images and cooling, a respective post-processing of the recording medium 10 in the post-processing module M4 takes place, which can, for example, comprise a cutting device 36*a* with a stacking device 37*a*.

Further, a microprocessor-controlled control device ST coupled to the device control GS of the printer is provided, which communicates with the components of the feed module M1, the printing module M2 and the fixing module M3 or the post-processing module M4 that are to be controlled and regulated. Within the modules, it is coupled to the individual aggregates as, for example, with the electrophotography modules E1 and E2 and the transfer modules T1 and T2. Connected to the device control GS or the control device ST, which can be part of the device control, is a control panel B via which the various operating states can be entered. The control panel can have a touch screen or a personal computer having a keyboard coupled thereto.

Although further above the preferred embodiment has primarily been described with reference to printing devices with an electrophotographic printing process, it is obvious that it is also suitable for other printing devices or printing processes in which toner and carrier particles are combined to a developer mixture. Among these are, in particular, the magnetography and the ionography. Instead of the described LED comb used for the exposure of a photoconductor, also other drivable light sources, such as lasers, can be used.

The preferred embodiment is in particular suited to be executed fully or partly automatically by means of a computer program (software). Thus, it can also be distributed as a computer program module, as a data file on a data carrier such as a floppy disk or CD-Rom or as a data file via a data or communications network. Such comparable computer program products or computer program elements are also variations of the preferred embodiment. The sequence of the preferred embodiment can find use in a computer, in a printing device or in a printing system. It is clear that corresponding computers on which the preferred embodiment is used can include further technical devices known per se such as input means (keyboard, mouse, touch screen), a microprocessor, a data or control bus, a displaying device (monitor, display) as well as a working memory, a hard disk drive and a network card.

Various variations of the preferred embodiment have been described. It is obvious that the person skilled in the art can readily specify variations and developments thereof. For example, the preferred embodiment can likewise be used in a printing system in which sheet-shaped recording media are processed instead of band-shaped recording media. Furthermore, it is obvious that any numerical data are only exemplarily and can readily be varied without leaving the scope of the preferred embodiment.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A method for generating a developer mixture in a developer station of an electrographic printing device, comprising the steps of:

simultaneously filling magnetizable carrier particles and toner into the developer station, and in case of an error or an aborting of the filling, a continuation of the filling of at least one of the carrier particles and toner takes place at a later time of the method.

2. A method of claim 1 wherein for said later continuation of the method, a last acquired amount of at least one of said carrier particles or said toner is used.

3. A method according to claim 1 wherein at first only carrier particles are filled into the developer station and after a beginning of the filling process for carrier particles toner is additionally filled into the developer station.

4. A method according to claim 3 wherein between the beginning of the filling in of carrier particles and a beginning of the filling in of toner, a predetermined amount of time passes by, which is calculated such that a predetermined amount of carrier particles is filled into the developer station before the filling in of the toner is started.

5. A method according to claim 1 wherein the carrier particles and the toner are mixed simultaneously with the filling.

6. A method of claim 1 wherein said method for generating a developer mixture occurs when a pre-existing developer mixture is being changed in said developer station and wherein the following further steps are provided:

providing a first phase in which a used developer mixture is drained off from the developer station; and providing a second phase in which a new developer mixture is generated in that new carrier particles and toner are filled into the developer station, process step-by-process step or continuously, and are mixed, an amount of carrier particles supplied and/or of toner supplied being automatically acquired regularly.

7. A method of claim 6 wherein several developer stations are simultaneously filled.

8. A method according to claim 7 wherein it is checked whether a first developer station has reached a first status value, which indicates that a developer mixture of said first developer station is to be replaced and it is checked for at least another developer station whether it has reached a second status value which indicates that a developer mixture of the second developer station also has to be replaced when the first developer mixture is replaced.

9. A method according to claim 8 wherein the first and second status values comprise first and second page counter limits and wherein the second page counter limit is lower than the first page counter limit.

10. A method according to claim 6 wherein in the second phase a mixing of the carrier particles and of the toner takes place, a length of the mixing time for the mixing being acquired.

11. A method according to claim 6 wherein the method is implemented in a computer-assisted manner.

12. A method of claim 1 wherein developer mixture relevant status data are stored on a non-volatile electric memory of the developer.

13. A method according to claim 12 wherein a full/empty status and/or a process phase status is stored in the memory.

14. A method according to claim 12 wherein amount values and/or time values of carrier particles and/or toner particles acquired during the generation of the developer mixture are stored.

15. A method according to claim 12 wherein a value for a mixing time of carrier particles and toner is stored.

16. An electrographic printing device for generating a developer mixture, comprising:

a developer station;

a computer; and computer program in said computer, said computer program controlling a simultaneous filling of magnetizable carrier particles and toner into the developer station, and in case of an error or aborting of the filling, a continuation of the filling of at least one of the carrier particles and toner takes place at a later time of the method.

17. A computer-readable medium comprising a computer program for generating a developer mixture in a developer station of an electrographic printing device, said computer program performing the step of controlling a simultaneous filling of magnetizable carrier particles and toner particles into said developer station, and wherein, in case of an error or an aborting of the filling, providing a continuation of the filling of at least one of the carrier particles and toner at a later time.

* * * * *